United States Patent [19]

Young

[11] 4,397,932

[45] Aug. 9, 1983

[54] ELECTROPHOTOGRAPHIC COMPOSITION AND ELEMENTS

[75] Inventor: Hepburn S. Young, Evanston, Ill.

[73] Assignee: A. B. Dick Company, Chicago, Ill.

[21] Appl. No.: 314,976

[22] Filed: Oct. 26, 1981

[51] Int. Cl.[3] ..... G03G 5/05; G03G 5/06

[52] U.S. Cl. ..... 430/81; 430/82; 430/127

[58] Field of Search ..... 430/81, 79, 127, 82

[56] References Cited

U.S. PATENT DOCUMENTS

| | | | |
|---|---|---|---|
| 3,076,707 | 2/1963 | Lawton et al. . | |
| 3,149,992 | 9/1964 | Lawton | 430/155 |
| 3,736,166 | 5/1973 | Lawton . | |
| 4,094,687 | 6/1978 | Lawton . | |
| 4,180,405 | 12/1979 | Lawton . | |

*Primary Examiner*—John E. Kittle
*Assistant Examiner*—John L. Goodrow
*Attorney, Agent, or Firm*—McDougall, Hersh & Scott

[57] ABSTRACT

An electrophotographic member having increased sensitivity to a longer wave length formulated of a complex formed by the reaction of Ninhydrin with a tertiary amine and which includes a polyalkenyl carbazole.

14 Claims, No Drawings

ELECTROPHOTOGRAPHIC COMPOSITION AND ELEMENTS

This invention relates to electrophotography and to an improvement in commercial file film electrophotographic processes.

In the copending application of James M. Halm, Ser. No. 131,150, filed Mar. 17, 1980, as a continuation of application Ser. No. 897,719, filed as a continuation-in-part of application Ser. No. 737,148, filed October 29, 1976, description is made of a photoconductive coating composition formulated of a poly-N-vinyl carbazole as a donor compound and a metal chelate, preferably a boron chelate as an acceptor-sensitizer. Compositions of the type described can be coated onto suitable conductive substrates to provide photoconductive elements that can be imaged by conventional electrophotographic technique to provide latent electrostatic images capable of being developed into visible images with liquid or dry powder developer and in which the image developed with dry powder can be transferred for fixing onto another element, such as plain paper in a plain paper copier.

Electrophotographic layers which have been fabricated of donor-acceptor components of the type described in the aforementioned copending application are lacking somewhat in sensitivity and they are limited further in the length of waves suitable for use in the formation of an optimum electrostatic image.

It is an object of this invention to provide an improved composition for photoconductive coating having increased wave lengths and which is better adapted for use in electrostatic file film processes and elements.

The described objectives can be obtained, in accordance with the practice of this invention, by reaction of a Ninhydrin with a tertiary amine to form a charge transfer complex which, when admixed with a poly-N-vinyl carbazole, provides an electrophotographic composition having improved sensitivity and suitable for use with longer wave lengths.

The invention will hereinafter be illustrated by the following specific examples:

EXAMPLE 1

| Composition | Parts by weight |
|---|---|
| Ninhydrin | 4 |
| Tertiary amine | 3 |
| Poly-N—vinyl carbazole | 50 |
| Tetrahydrofuran | 700 |
| Cyclohexanone | 300 |

The Ninhydrin, tertiary amine and poly-N-vinyl carbazole are dissolved in the mixed solvents of tetrahydrofuran and cyclohexanone, using a magnetic stirrer bar. A bluish green color develops in less than one hour.

The composition was coated onto a film of metalized Mylar with a #60 wire wound rod to provide a coating having a thickness of about 6 μm.

Upon drying in air or at a temperature up to about 50° C., the substrate showed little if any color. After exposure to roomlight, under ambient conditions, a blue-green color developed.

The coated film was exposed to an xenon flash in an A. B. Dick Microprocessor System 200, using a Dataquest original with a format of colors, gray scales and lines. An electrostatic image was produced on the film which was subsequently developed with a positively charged liquid toner by conventional xerographic technique.

The imaged film was viewed in an A. B. Dick recorder-viewer. The image compared favorably with that of other commercial electrophotographic systems.

The following is representative of the Ninhydrin employed in the practice of the invention and used in Example 1 as the electron acceptor:

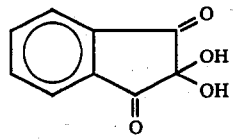

The Ninhydrin or derivatives thereof are preferably employed in the coating composition in the amount within the range of 0.2–0.5 percent by weight of the coating composition and preferably in an amount within the range of 0.3–0.5 percent by weight.

As the tertiary amine, as in Example 1, it is preferred to make use of 4,4′-tetramethyl diamino triphenyl methane having the following structural formula

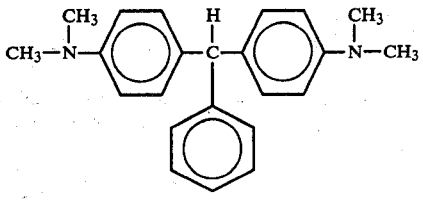

The above tertiary amine can be substituted, in whole or in part, with other tertiary amines capable of forming charge-transfer complexes with Ninhydrin, such as 4,4′4″-methylidynetris(N,N-dimethylaniline); methylene bis-(N,N-dimethylaniline). To form the desired charge-transfer complex, the tertiary amine should be employed in the ratio of about 0.25 to 25 moles of Ninhydrin per amine hydrogen and preferably in the weight ratio of one part by weight amine per 0.5–5 parts by weight Ninhydrin.

Instead of poly-N-vinyl carbazole used in Example 1, use can be made of other N-alkenyl carbazoles, substituted N-vinyl carbazole, and polymers and copolymers thereof, such as dibromo polyvinyl carbazole and polyvinyl iodo benzo carbazoles.

The combination of materials is effective to produce improved photo-conductive coatings for use in electrophotographic systems when present in the ratio of 5 to 500 parts by weight polyalkenyl carbazole donor to 10 to 100 parts by weight of the Ninhydrin—tertiary amine acceptor-sensitizer complex and preferably in the ratio of one part by weight complex to 1 to 20 and preferably 1 to 10 parts by weight of the polymeric binder.

The coating composition is suitably formulated as a solution in tetrahydrofuran, cyclohexanone and mixtures thereof which are representative of suitable inert organic solvents in which the materials are soluble, and in which the solid content should range from 1 to 10 percent by weight.

The photoconductor element can be prepared, in accordance with the practice of the invention, by application of the composition to form a layer on a suitable substrate, such as a highly conductive film of plastic, paper or the like, such as metalized film of Mylar, Nylon, polyester resin, polyacrylate, or the like plastic material.

In the preferred practice of this invention, the coating composition is used for coating a transparent conductive substrate such as metalized Mylar or other plastic film to provide a photoconductive transparent film suitable for use in commercial film processes.

The applied coating can be air dried or drying can be accelerated at elevated temperatures, such as up to a temperature of 50°-100° C. to provide the photoconductive coating on a suitable film substrate.

The resulting photoconductive element can be imaged in the usual manner to provide a latent electrostatic image that can be developed with a liquid or powder developer to provide a visible image that can be fixed to the element or transferred for fixing onto a copy sheet, such as paper, as in a plain paper copier.

EXAMPLE 2

| Composition | Parts by weight |
|---|---|
| Ninhydrin | 2 |
| 4,4',4''-methylidynetris (N,N—dimethylaniline) | 1 |
| Poly-N—vinyl carbazole | 60 |
| Tetrahydrofuran | 700 |
| Cyclohexanone | 300 |

As in Example 1, the materials are dissolved to form a solution in the mixture of tetrahydrofuran and cyclohexanone.

The composition was coated onto metalized film with a #60 wire wound rod to a coating thickness of 5-10 μm and then air dried.

The coated film was imaged by exposure to a transparent original, using a xenon flash in an A. B. Dick Microprocessor—System 200.

The formed latent electrostatic image was developed by xerographic technique, using a liquid developer, followed by heat sufficient to fix the image onto the substrate.

A clean reproduction of the original image was produced on the film base.

It will be understood that other means of exposure to produce the latent electrostatic image on the photoconductive coating can be employed in accordance with accepted xerographic practice.

Also, organic solvents other than tetrahydrofuran and cyclohexanone can be used in formulation of the coating compositions of Examples 1 and 2; however, such organic solvents should be inert and capable of solution of the reactive component.

A number of improvements are provided by the described electrophotographic process and compositions of this invention, namely:

Improved film panchromaticity.

Use of readily available, low cost materials, which are easily formulated into a stable composition.

Improved film fatigue characteristics, in that the electrical properties of the photoconductor composition remains substantially stable even after many hours, such as 100 hours, of room light exposure.

Ease of use in commercial file film processes.

Improved sensitivity over longer wave lengths.

It will be understood that changes may be made in the details of formulation and operation without departing from the spirit of the invention, especially as defined in the following claims.

I claim:

1. An electrophotographic member comprising a conductive substrate, a photoconductive coating on the substrate formulated of an electron-sensitizer complex formed by reaction of Ninhydrin with a tertiary amine and in which the coating composition includes a polyalkenyl carbazole.

2. An electrophotographic member as claimed in claim 1 in which the substrate is a metalized plastic film.

3. An electrophotographic member as claimed in claim 1 in which the polyalkenyl carbazole is poly-N-vinyl carbazole.

4. An electrophotographic member as claimed in claim 1 in which the tertiary amine is selected from the group consisting of 4,4'-tetramethyl diamino triphenyl methane; 4,4',4''-methylidyne tris(N,N-dimethylaniline); and methylene bis-(N,N-dimethylaniline).

5. An electrophotographic member as claimed in claim 1 in which the Ninhydrin and tertiary amine are present in the ratio of 0.25 to 25 moles of Ninhydrin per amine hydrogen of the tertiary amine.

6. An electrophotographic member as claimed in claim 1 in which the Ninhydrin and tertiary amine are present in the weight ratio of 1 part by weight tertiary amine per 0.5-5 parts by weight Ninhydrin.

7. An electrophotographic member as claimed in claim 1 in which the carbazole is present in the ratio of 3 to 500 parts by weight per 10 to 100 parts by weight of the complex.

8. An electrophotographic member as claimed in claim 1 in which the carbazole is present in the ratio of 1 part by weight of the complex to 1 to 10 parts by weight of the carbazole.

9. The method of preparing a photoconductive element comprising coating a conductive substrate with a photoconductive composition in the form of a solvent solution of an electron-sensitizer complex formed of Ninhydrin and a tertiary amine and which includes a polyalkenyl carbazole.

10. The method as claimed in claim 9 in which the solvent is selected from the group consisting of tetrahydrofuran and cyclohexanone.

11. The method as claimed in claim 9 in which the components are present in the solution in an amount within the range of 1 to 10 percent by weight solids.

12. The method as claimed in claim 9 in which the Ninhydrin and tertiary amine are present in the ratio of 0.25 to 25 moles of Ninhydrin per amine hydrogen.

13. The method as claimed in claim 9 in which the Ninhydrin and tertiary amine are present in the weight ratio of 1 part by weight amine per 0.5 to 5 parts by weight Ninhydrin.

14. The method as claimed in claim 9 in which the polyalkenyl carbazole is present in a weight ratio of 5 to 500 parts by weight and the complex of the Ninhydrin and tertiary amine are present in an amount of 10 to 100 parts by weight.

* * * * *